US010566754B2

(12) United States Patent
Lartique et al.

(10) Patent No.: US 10,566,754 B2
(45) Date of Patent: Feb. 18, 2020

(54) SPLIT BRUSH WITH METAL CLIP

(71) Applicant: MERSEN FRANCE AMIENS SAS, Amiens (FR)

(72) Inventors: Pascal Lartique, Naours (FR); Laurent Lochet, Talmas (FR)

(73) Assignee: MERSEN FRANCE AMIENS SAS, Amiens (FR)

( * ) Notice: Subject to any disclaimer, the term of this patent is extended or adjusted under 35 U.S.C. 154(b) by 356 days.

(21) Appl. No.: 15/524,152

(22) PCT Filed: Nov. 4, 2014

(86) PCT No.: PCT/FR2014/052797

§ 371 (c)(1),
(2) Date: May 3, 2017

(87) PCT Pub. No.: WO2016/071580

PCT Pub. Date: May 12, 2016

(65) Prior Publication Data

US 2017/0324204 A1 Nov. 9, 2017

(51) Int. Cl.

| | |
|---|---|
| ***H01R 39/26*** | (2006.01) |
| ***H01R 39/38*** | (2006.01) |
| *H01R 39/20* | (2006.01) |

(52) U.S. Cl.

CPC ..... *H01R 39/26* (2013.01); *H01R 39/381* (2013.01); *H01R 39/20* (2013.01); *H01R 2201/26* (2013.01)

(58) Field of Classification Search

CPC ..... H01R 39/381; H01R 39/26
See application file for complete search history.

(56) References Cited

U.S. PATENT DOCUMENTS 2,918,591 A * 12/1959 Lyddon ..... H01R 39/24 310/248
2,959,698 A * 11/1960 Titus ..... H01R 39/24 310/248
3,158,772 A 11/1964 Krellner

FOREIGN PATENT DOCUMENTS

FR 1 482 177 A 5/1967
GB 1 119 614 A 7/1968

OTHER PUBLICATIONS

International Search Report, dated Jun. 11, 2015, from corresponding PCT application.

* cited by examiner

*Primary Examiner* — Dang D Le
(74) *Attorney, Agent, or Firm* — Young & Thompson

(57) ABSTRACT

A brush device includes: a first and a second flange disposed side by side, each flange extending radially between a rubbing face intended to rub against a moveable element and a flange head intended to be connected electrically to another moveable element, a first plate rigidly fixed to the first flange only and extending tangentially above the head of the second flange, in such a way as to transmit, when this first plate is loaded by pressure unit, pressure forces on the second flange, a second plate, distinct from the first plate, rigidly fixed to the second flange only and extending tangentially above the head of the first flange in such a way as to bear on the first flange in the event of relative motion of the second flange with respect to the first flange towards the first moveable element.

14 Claims, 2 Drawing Sheets

SPLIT BRUSH WITH METAL CLIP

The invention relates to the field of brushes intended to provide electrical contact between a fixed part/element and a rotating part/element in a rotating electrical machine. This rotating part may, for example, be a commutator part of an electric motor or a ring of a synchronous or asynchronous machine.

More precisely, the invention relates to a brush for an electrical machine, and more particularly a split brush.

It is known to assemble several wafers, habitually graphite-based, side by side to limit sparks and vibration effects, notably when the element intended to slide against the brush comprises several commutator bars, each having an associated electric potential and being susceptible to have misalignment defects from one bar to the other. Providing several wafers may thus allow for better contact, even in the case of surface defects.

A split brush thus comprises two wafers disposed side by side and each extending between a contact surface, intended to slide against the mobile element relative to the brush, and an top surface at the top of the wafer.

The mobile element in relation to the brush may, for example, comprise a commutator of an electrical machine.

A pressing system allows pressure to be exerted on each of the wafers, on the top surfaces, so that the contact surfaces slide against the mobile element.

A split brush is known comprising two wafers, each having a beveled top, and an edge on which a spring presses, so that a force is applied to each wafer.

Document U.S. Pat. No. 3,158,772 describes an example of such a split brush with an edge, wherein the forces are applied symmetrically to each wafer.

However, the forces applied may tend to spread the wafers apart, such that there is a risk that the wafers may wear against the walls of a brush holder providing lateral support for the wafers.

Split brushes are also known with two wafers, and a plate riveted to one of the wafers only, and extending above the top surfaces of the two wafers, such that the pressure exerted by a spring on this plate is transmitted to both wafers. These brushes are said split brushes with metal clip.

However, it is understood that the wafer not riveted to this plate, called the independent wafer, led wafer, driven wafer or free wafer, is susceptible to moving with respect to the wafer rigidly fixed to the plate, said lead wafer or driver wafer. Owing to these relative movements of the free wafer relative to the lead wafer, there is a risk of electrical arcing, and therefore accelerated wear of the contact surface of the free wafer. As a result, the free wafer may be shorter in length than the lead wafer, such that the contact provided by the plate against this free wafer risks decreasing further, which tends to accentuate the relative displacements of the lead wafer, and thus its wear.

There is, therefore, a need for a split brush with metal clip that allows more uniform wear from one wafer to another.

It is known to provide an additional anti-vibration layer as described in document GB 1,119,614, for example. This solution may prove to be insufficient, however, in the case of an environment susceptible to experience relatively strong vibrations.

Consideration was given to the idea of rigidly fixing the two wafers to one another, but it is feared that this solution has an increased risk of electrical arcing, notably in the case of a commutator with bars susceptible to be relatively poorly aligned.

Consideration was also given to the idea of bonding the two wafers together with a flexible adhesive (sandwich brush), to authorize the relative movements of low amplitude, and to prohibit the relative movements of greater amplitude. However, and particularly in the case of an environment susceptible to experience relatively strong vibrations, there is a risk of the wafers becoming separated. Also, the amplitude of the authorized movements would remain relatively limited.

A brush device is proposed for the transmission of electric power between a first and a second element, mobile in relation to one other, comprising:

- two wafers disposed side by side, each wafer extending radially between a contact surface intended to slide against the first mobile element and a wafer top intended to be electrically connected to the second element,
- a first plate rigidly fixed to the first wafer only, and extending tangentially over at least a portion of the top of the second wafer, so as to transmit pressure forces, when pressing means, for example a spring, bias the first plate, onto the second wafer so that the contact surfaces of the first and second wafers slide on the first mobile element.

According to the invention, the brush device further comprises a second plate, distinct from the first plate, rigidly fixed to the second wafer only and extending tangentially over at least a portion of the top of the first wafer so as to press on said first wafer in case of relative movement of the second wafer in relation to the first wafer toward the first mobile element.

Thus, if, owing to external vibrations, for example, the second wafer is displaced relative to the first wafer toward the first mobile element, for example, a commutator, this second plate drives the first wafer toward the first mobile element. The two wafers thus remain relatively interdependent with each another, such that the wear from one wafer to the other remains relatively uniform.

When the relative movement of the second wafer in relation to the first wafer tends to move the second wafer away from the first mobile element, the first plate limits the travel of the second wafer, keeping this second wafer close to the first mobile element.

Due to the functional clearance, and possibly slight clearance between the wafers and plates, the movements of the second wafer relative to the first wafer of relatively low amplitude (along the radial dimension) do not cause any additional movement of the first wafer. The brush device may thus ensure relatively good quality contact, even in the case of a first element that is relatively non-planar, for example with bars having relatively poor radial alignment (surface defects or, in the case of a first circular element, out-of-roundness).

Advantageously, the brush device may be designed with sufficient clearance(s) between the parts of this device so that the second wafer may be driven in motion relative to the first wafer over a range of travel determined according to the radial direction without driving the first wafer in motion. This range of travel may correspond to a distance between 0.1 mm and 1 mm, advantageously 0.2 mm and 0.4 mm, for example, 0.3 mm. Thus, the first wafer may be driven in motion by the second plate only if the displacement of the second wafer relative to the first wafer corresponds to a distance, according to the radial direction and from an end position of the predetermined range, greater than a threshold, for example a threshold between 0.01 mm and 2 mm, advantageously between 100 μm and 1 mm, for example 500

μm. The brush device remains susceptible to have relative motions, along the radial direction, corresponding to an amplitude, below this threshold, which contributes to the quality of the electrical contact.

In particular, the brush device may be designed so that when the first plate transmits the pressure forces to the second wafer, the second plate and the part of (or attached to) the first wafer susceptible to be abutted against the second plate in case of relative motion of the second wafer in relation to the first wafer toward the first mobile element may be separated by a clearance having a thickness according to the radial direction.

This thickness corresponds to the authorized travel of the second wafer relative to the first wafer. This thickness may be chosen, for example, between 0.1 mm and 1 mm, advantageously between 0.2 mm and 0.4 mm, for example, 0.3 mm, since it has been observed that the deviations of alignments of the bars correspond to a difference in height generally in the order of a few hundred microns.

Advantageously, the second plate may press directly on the first wafer.

Alternatively, provision may also be made so that the second plate extends above the first plate, so as to press on this first plate secured to the first wafer.

Each plate may comprise an attachment portion rigidly fixed to a side or frontal face of the corresponding wafer, and a pressing part extending tangentially above at least a portion of the top of the other wafer.

The expression "above" is to be understood in a frame of reference associated with the brush, and not in the terrestrial reference frame. In other words, the top surface of the brush is above the contact surface, regardless of the orientation of the brush in the terrestrial reference frame.

Each wafer extends between the contact surface and a top surface at the end of the top.

Each plate may be susceptible to abut against a surface of (or fixed to) the corresponding top, said pressing surface. This pressing surface may, for example, be a portion of or the entire top surface of the wafer corresponding to this plate (for example, the second wafer in the case of the first plate).

Furthermore, the expression "above", may also be understood as "directly above" and "indirectly above", i.e. an intermediate layer may be provided between a plate and the corresponding pressing surface.

The wafers may be made of the same material, in which case we will speak of a split brush assembly, or of different materials, in which case we speak of a composite brush assembly, or in two grades.

Advantageously, and in a non-limiting manner, the second plate may extend above the top surface of the first wafer.

Alternatively, consideration may be given to machining a groove in the first wafer, at the top, this groove extending in a plane normal to the radial direction and opening on a frontal or lateral face of the wafer, and a part of the second plate being received in this groove. In this embodiment, the second plate does not abut the top surface, at the end of the first wafer, but it abuts a pressing surface away from this top surface. The second plate extends above a portion only of the top the first wafer, since another portion of the top of the first wafer, between the upper edge of the groove and the top surface, is above the second plate.

Advantageously, and in a non-limiting manner, the second plate may extend above the top surfaces of the first and second wafers.

Advantageously, and in a non-limiting manner, the second plate may extend above the top surface of the first wafer, and advantageously above the second wafer, in a sufficiently central location so that the cables may be fixed to these top surfaces, on either side of this second plate.

Alternatively, the second plate may extend above the top surfaces of the first and second wafers, while adjoining a side face of each of the wafers. In other words, the second plate may occupy the location intended for a cable, and on each of the wafers.

It is therefore understood that it is advantageous to free up this space so that each wafer may be connected to a sufficient number of cables, two for example.

Advantageously, and in a non-limiting manner, the second plate may extend between the first plate and the top surface of the first wafer and/or of the second wafer. A space is thus provided between the first plate and the top surface of the first wafer and/or of the second wafer for the insertion of the second plate. The clearance of 300 μm described above, for example, may be a clearance between the top surfaces of the wafers and the second plate when the plates are in contact.

Advantageously, consideration may be given to creating notches in the first and/or the second wafer to receive the second plate. More precisely, the wafers may define notches to receive the pressing part of the second plate.

Advantageously, and in a non-limiting manner, the first plate may extend beyond the second wafer. Such a cantilever plate may make it possible to avoid the friction of the first mobile element against any rivets at the end of the service life of the wafers. A flange may be provided, on a brush holder for example, against which this protruding end of the first plate abuts when the wafers are relatively short, thereby holding the two wafers away from the first mobile element.

The invention is in no way limited to the material(s) chosen for each of the wafers. For example, wafers composed primarily of carbon or metal, for example silver, may be used. One and/or the another wafer may thus be made from amorphous carbon, natural graphite, a mixture of amorphous carbon and graphite (carbographite brush), a mixture of metal and graphite, metal-impregnated graphite, graphite and a binder comprising a synthetic resin (brush agglomerated with a synthetic resin), and/or others.

The contact surface may be curved or planar.

The top of each wafer may have a curved or uncurved top surface, particularly in the case of a rounded top. However, notched tops will advantageously be provided for the wafers so that the plates may be received in the notches.

The first plate thus may or may not be a cantilever pressing plate.

Advantageously, and in a non-limiting manner, the first plate and/or the second plate may be fixed to the first wafer and/or the second wafer, respectively, by riveting.

Alternatively, bonding may also be provided even if riveting allows for or offers better mechanical stability, which may be particularly interesting in an environment with relatively high vibration levels.

Advantageously, and in a non-limiting manner, the brush device may further comprise cables fixed to the first and second wafers. This attachment may advantageously be performed by riveting, or even by sealing, soldering or other means.

Advantageously, and in a non-limiting manner, the second plate may define, at one end, above the first wafer, a flange extending in a direction having a radial component, and the first plate may define a cavity to receive this flange so that the first and the second plate cooperate with each other when the wafers cooperate with each other. The fastening of the two wafers may thus be improved.

The height of the brush, in the radial direction, may be in the order of a few centimeters, for example between 1 cm and 4 cm.

The thickness of the brush, in the tangential direction, may be in the order of a few centimeters, for example between 0.8 cm and 4 cm.

An electrical machine is further proposed comprising a brush device as described above.

The invention may notably find application in the field of transport, particularly in the aerospace sector, particularly aeronautics, space or other, the rail transport sector or other. More particularly, the invention may be implemented in a starter-generator with brushes.

The invention, however, is in no way limited to this application in the field of transport. For example, all of the brushes described below may be used in a forklift or other machines.

It is further proposed to use the brush device described above and/or the rotating electrical machine described above in an aircraft or a spacecraft, for example, a space shuttle.

The invention shall be better understood when taken in conjunction with the figures, which illustrate the embodiments which are non-limiting and given by way of example.

Identical references may be used from one figure to another to designate identical or similar elements, in form or in function.

The brush devices illustrated were designed for brush starters-generators, for an aeronautical application.

These brush devices, also called brushes, are thus intended to be subjected to relatively strong vibrations, and possibly to relatively high temperatures since electrical machines may be integrated or enclosed. These vibrations are susceptible to cause miscellaneous damage to an electrical machine. For example, there is a risk that the brush becomes detached.

Advantageously, consideration may be given to riveting the cables to the wafers so as to limit this risk.

There is also a risk of damaging the cables, or even the insulating sheaths.

In addition, the front faces of the brush, or sometimes even the side faces, are likely to wear due to the friction of the brush in the brush holder.

Finally, the contact surface and the edges of the brush are susceptible to experience relatively high electrical wear due to electrical arcing induced by the brush jumping on the commutator, particularly when the bars of the commutator are imperfectly aligned.

The use of split brushes may largely compensate for this latter disadvantage since the electrical contact with the bars of the commutator may be more effective.

Figure 1:
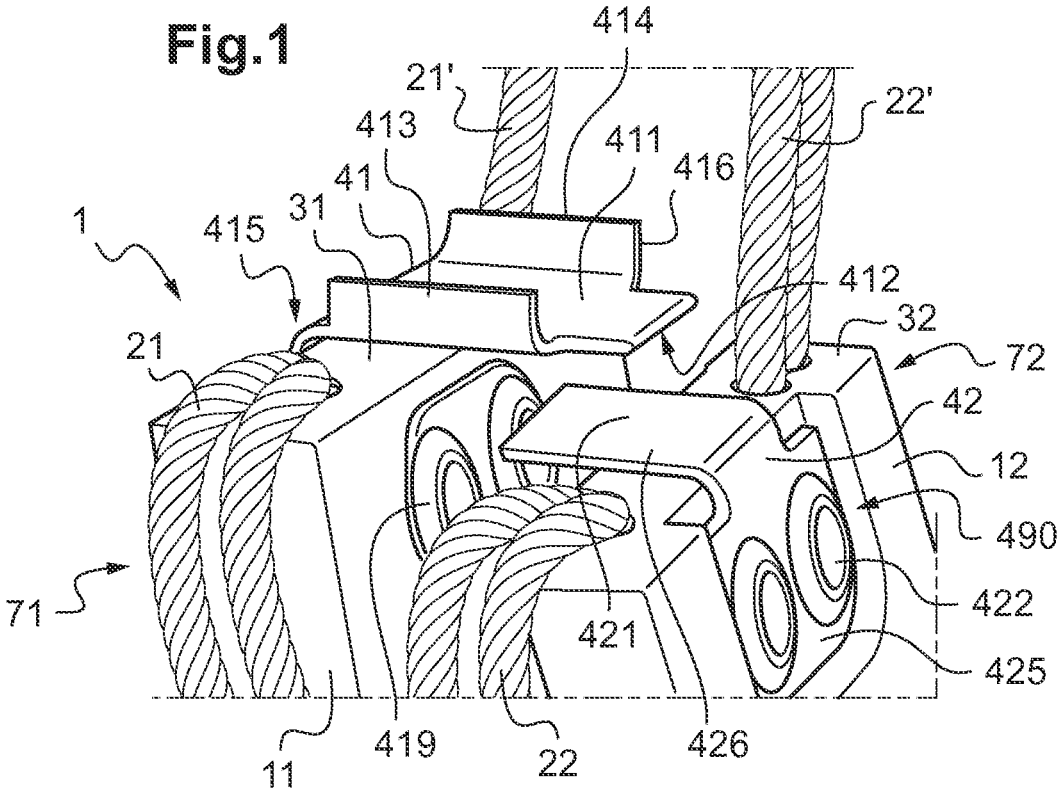
FIG. 1 is a perspective view of a part of an example of a brush device according to an embodiment of the invention, in a separated state.

In reference to FIG. 1, the brush device 1 comprises a first wafer 11 and a second wafer 12, normally placed against one other. In FIG. 1, these wafers 11, 12 are in a separated state.

Figure 4:
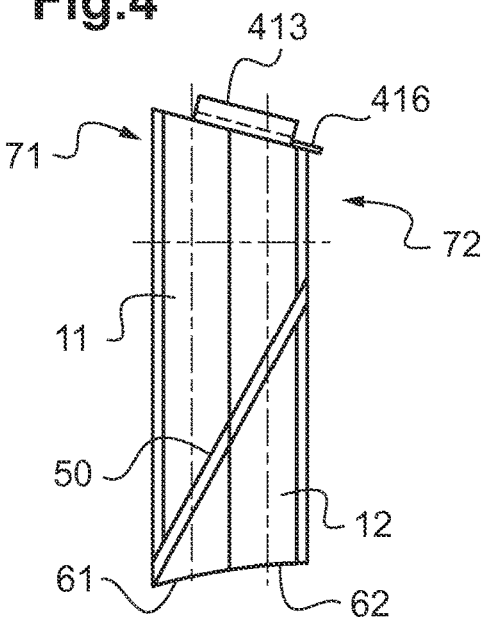
FIG. 4 is a view of a side face of an example of a brush device according to an embodiment of the invention.

The top of the brush 1 is slightly beveled, i.e. that the top surfaces 31, 32 form a light angle with the contact surfaces not visible in FIG. 1. FIG. 4, described below, shows another brush example having such an angle. This may allow for better mechanical stability.

The cables 21, 21', 22, 22' are riveted to wafers 11, 12.

A first plate 41 is fixed by riveting to the first wafer 11. This first plate 41 comprises an attachment part 415 secured by rivets 419 to the first wafer.

The first plate 41 further comprises a supporting part 416, of one single piece with the attachment part 415, and extends above the tops of wafers 11 and 12, so that, if a spring (not shown) exerts pressure on an upper planar surface 411 of this pressing part 416, the first wafer 11 is under this pressure due to the rigid attachment to the first plate 41, and the second wafer 12 is also under this pressure since the pressing part 416 abuts against a planar surface 421 of a second plate 42 rigidly fixed to the second wafer 12.

This second plate 42 comprises an attachment part 425 fixed by rivets 422 to the second wafer 12, and a pressing part 426 in the general shape of a strip. The parts 425, 426 are made in one piece.

When the wafers 11, 12 are assembled, the pressing part in the shape of a tab 426 becomes housed between the upper surface 31 of the first wafer 11, and a lower planar surface 412 of the pressing part 416 of the first plate 41 opposite the upper planar surface 411. Thus, if the second wafer 12 is driven, for example, due to vibrations, toward a commutator (not shown), such that the second wafer 12 tends to move away from the first wafer 11, the planar surface 421 of the second plate 42 exerts pressure on the upper surface 31 of the first wafer 11, such that the first wafer 11 is driven toward the commutator.

The invention is in no way limited by the form of the pressing system used. A spring, or other element, may be provided.

The rivets 419 (422, respectively) used to secure the attachment part 415 (425, respectively) extend tangentially so as to traverse the top 71 of the first wafer 11 (top 72 of the second wafer 12, respectively).

These rivets 419 (422, respectively) are also used to fix the cables 21, 21' (cables 22, 22', respectively). More precisely, during the manufacture of the brush, cavities are formed in the wafers 11, 12 to receive the rivets 419, 422. The cable ends are wrapped around the rivets, then a welding is performed to rigidly secure the cables and platelets on the wafers.

The first plate 42 is cantilever, such that at the end of service life, the part 416 forming a tab is blocked on a cage of a brush holder (not shown). Owing to the cooperation of the part 426 of the second plate with the first wafer 11, the second wafer 12 also remains suspended.

This brush 1 is advantageous in relation to the existing split brush with pressing plate, in that the wear of the wafers is more symmetrical than with these existing brushes. For the existing split brushes with pressing plates, the pressure exerted by the spring may be relatively uneven. The second wafer, said free wafer, may be susceptible to receive less pressure thrust than the first wafer, and, as a result, there is a risk of slippage with respect to the first wafer.

With the brush 1, the risk of friction wear between the two opposing faces of the wafers is thus reduced.

In addition, the cables 22, 22' fixed to the second segment will likely be under less stress than in the prior art.

In addition, electrical wear of the second wafer 12 may be less than in the prior art since, with this brush 1, the relative movements of excessive amplitude are thus prevented. The invention may therefore limit the degradation of the commutator and disconnection of the generator.

In addition, when the brush 1 reaches the end of its service life, i.e. when the lead wafer 11 is blocked by the cantilever end of the first plate 41 pressing on the cage of the brush holder (not shown), the free wafer 12 is also held suspended, owing to the second plate 42.

In addition to the upper planar surface 411, the first plate 41 defines two side edges 413, 414 protruding from said surface 411. These edges 413, 414 make it possible to maintain the end of spring on the surface 411.

The plates 41, 42 occupy a central position on the top surfaces of the wafers 11, 12 thereby freeing up the locations for the attachment of cables 21, 21', 22, 22'.

Figure 2:
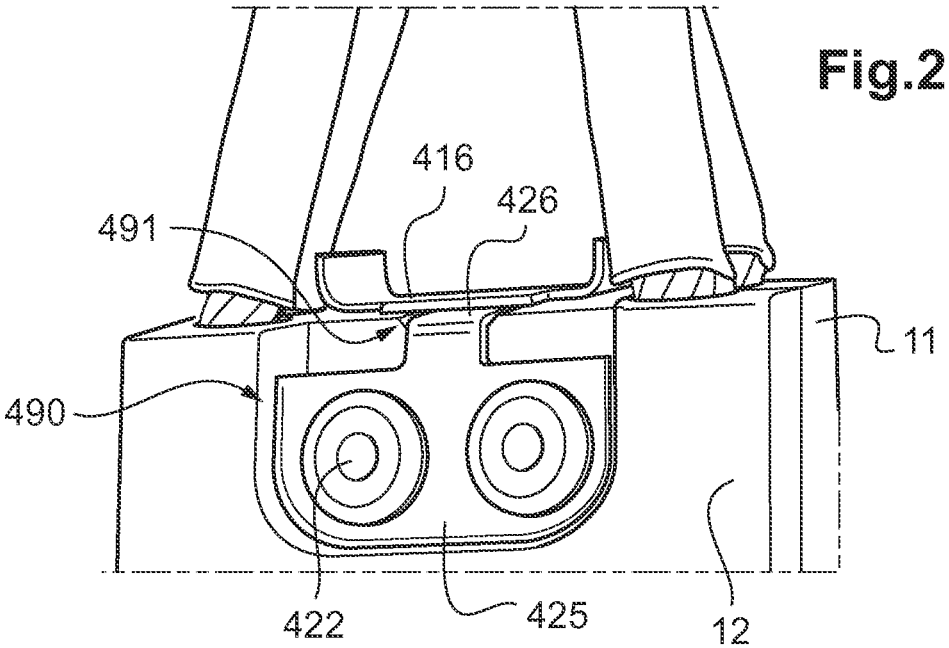
FIG. 2 is a perspective view of an example of a brush device according to another embodiment of the invention.

In the embodiment of FIG. 2, notches 491 are provided on the tops of the wafers 11, 12, to receive the pressing part 426 of the plate 42. These notches form a groove having dimensions substantially corresponding to those of the pressing part 426.

The raising of the pressing part 426, therefore, remains limited, and advantageously the height of the notches (depending on the radial direction) is slightly greater than the thickness of the metal sheet from which the second plate is made, such that the pressing part 426 of the second plate is flush with the upper surface of each of the wafers 11, 12. We may thus consider using a first plate with the same dimensions and the same position relative to the first wafer, as in the prior art.

Thus, the pressing part 426 is slid into the notch on the top of the lead wafer 11. The two wafers may be relatively well adjusted with respect to one other, and the support of the spring on the free wafer 12 may be improved.

An additional notch 490 is further provided, extending radially, to receive the attachment part 425 of the second plate 42.

Figure 3:
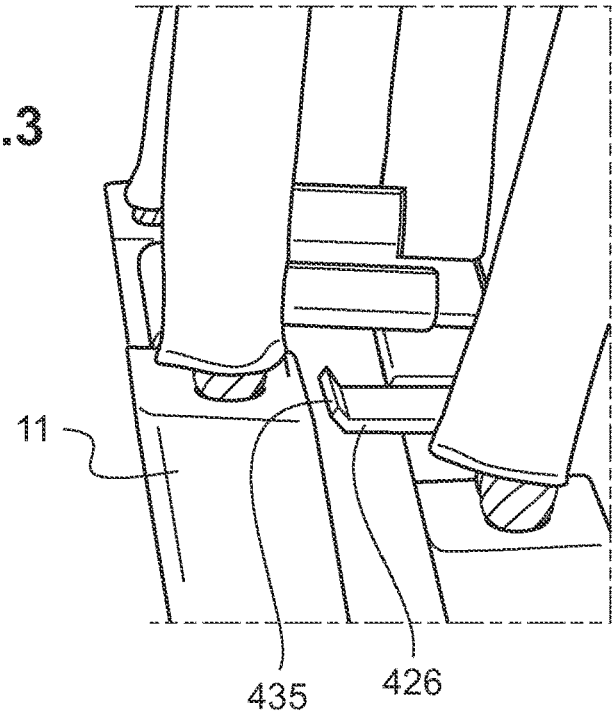
FIG. 3 is a perspective view of an example of a brush device according to an embodiment of the invention, in a separated state.

In the embodiment of FIG. 3, the pressing part 426 of the second plate 42 defines a projecting end 435, and the first plate 41 defines a recess, not visible in FIG. 3, to receive this projecting end 435. The free end of the second plate is thus bent, and an arrangement is provided in the plate 41 of the lead wafer 11 so that the plates 41, 42 fit into one another, thereby improving the fastening of the wafers 11, 12.

As shown in FIG. 4, a kerf 50 may be provided on one side face, or on both side faces.

As shown in FIG. 4, the angle formed between the top surfaces and a plane normal to the radial direction (typically the plane of the contact surfaces in the case of planar contact surfaces) may be in the order of 15°.

Furthermore, it may be noted that in the example illustrated in this figure, the contact surfaces 61, 62 are curved, the wafers 11, 12 being shaped and disposed so that these faces 61, 62 form a surface with relatively little discontinuity between the wafers 11, 12.

Figure 5:
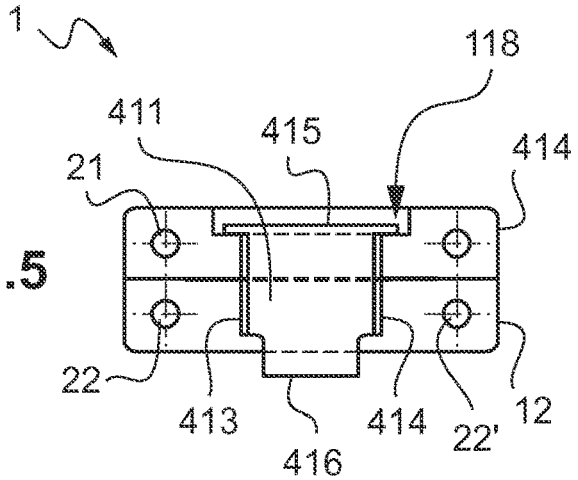
FIG. 5 is a top view of an example of a brush device according to an embodiment of the invention.

As shown in FIG. 5, a notch 118 extending radially may be defined in the first wafer, to receive the attachment part 415 of the first plate 41.

The wafers 11, 12 may be made of electrographite or metal-graphite material, for example, copper-graphite or silver-graphite. These brushes may be impregnated, especially for an application in the aeronautics sector.

The invention may thus help to improve the wear symmetry of the wafers, and thus limit the risk of damage to the generator in a relatively simple and reliable manner and without downgrading the performance characteristics of the brush.

Furthermore, it may be noted that the brush described above may be compatible with rings known in the prior art. This brush may thus be used in place of an existing brush.

The invention claimed is:

1. A brush device (1) for transmission of electric power between first and second elements that are mobile in relation to one other, the brush device comprising:

first (11) and second (12) wafers disposed side by side, each of said first and second wafers extending radially between a contact surface and a wafer top (71, 72);

a first plate (41) rigidly affixed to the first wafer only, and extending tangentially over at least a portion of the top of the second wafer, such that when pressing means bias the first plate, the first plate transmits pressure forces onto the second wafer via contact between the first plate and the second plate; and a second plate (42), distinct from the first plate, rigidly affixed to the second wafer only, and extending tangentially over at least a portion of the top of the first wafer so as to press on a topmost portion of said first wafer in case of relative movement of the second wafer in relation to the first wafer toward the first mobile element, wherein the first and second plates are configured such that when the first plate (41) transmits the pressure forces onto the second wafer (12), the second plate (42) is distanced from a topmost portion of said first wafer by 100 μm to 1 mm.

2. The brush device (1) as claimed in claim 1, wherein each wafer (11, 12) extends between the contact surface (61, 62) and an top surface (31, 32) at the end of the top (71, 72), wherein the second plate (42) extends above the top surface (31) of the first wafer.

3. The brush device (1) as claimed in claim 2, wherein the second plate (42) extends between the first plate (41) and the top surface (31, 32) of the first wafer (11) and of the second wafer (12).

4. The brush device (1) as claimed in claim 1, wherein the second plate (42) comprises an attachment part (425) rigidly fixed to a side or front face of the second wafer, and a pressing part (426) extending tangentially above the top of the first wafer (11), wherein the wafers (11, 12) define notches (491) to receive the pressing part of the second plate.

5. The brush device (1) as claimed in claim 1, wherein the first plate (41) is cantilevered.

6. The brush device (1) as claimed in claim 1, wherein the first plate (41) and the second plate (42) are fixed to the first wafer (11) and to the second wafer (12), respectively, by riveting.

7. The brush device (1) as claimed in claim 1, wherein the second plate (42) defines, at one end above the first wafer, a flange (435) extending in a direction having a radial component, and the first plate (41) defines a cavity to receive this flange so that the first and the second plate cooperate with each other when the wafers (11, 12) cooperate with one other.

8. A rotating electrical machine comprising a brush device (1) as claimed in claim 1.

9. An aircraft or a spacecraft comprising the brush device (1) of claim 1.

10. A brush device (1) for transmission of electric power between first and second elements that are mobile in relation to one other, the brush device comprising:

a first wafer (11);

a second wafer (12) positioned adjacent to the first wafer;

a first plate (41), with a first fixed end rigidly affixed to the first wafer and a first free end extending tangentially over an entirety of a first top portion (31) of the first wafer and over a portion of a second top portion (32) of the second wafer;

a second plate (42), with a second fixed end rigidly affixed to the second wafer and a second free end extending tangentially over an entirety of the second top portion of the second wafer and over a portion of the first top portion of the first wafer, a lowermost surface of the first plate, facing a topmost surface of the first top portion of the first wafer, being spaced from the topmost surface of the first wafer such that the second free end of the second plate is positioned between the lowermost surface of the first plate and the topmost surface of the first wafer, wherein, upon a force being applied to an upper surface of the first plate, the first plate transmits pressure forces onto the second wafer via contact between the first plate and the second plate, and wherein, upon relative movement of the second wafer relative to the first wafer in a downward direction, a lowermost surface of the second plate presses upon the first top portion of the first wafer.

11. The brush device (1) as claimed in claim 10, wherein the second free end of the second plate has a degree of freedom between the topmost surface of the first wafer and the lowermost surface of the first plate has a degree of freedom, in a thickness direction of the second free end, between 100 μm and 1 mm.

12. The brush device (1) as claimed in claim 10, wherein the first fixed end is rigidly affixed to a first side of the first wafer, wherein the second fixed end is rigidly affixed to a second side of the second wafer, and wherein the first side of the first wafer faces opposite the second side of the second wafer.

13. The brush device (1) as claimed in claim 12, wherein the first fixed end is rigidly affixed to the first side of the first wafer by rivets extending into the first side of the first wafer, and wherein the second fixed end is rigidly affixed to the second side of the second wafer by rivets extending into the second side of the second wafer.

14. The brush device (1) as claimed in claim 10, wherein the second free end is positioned directly above the topmost surface of the first wafer.

* * * * *